US005877672A

United States Patent [19]

Tsuda et al.

[11] Patent Number: 5,877,672

[45] Date of Patent: Mar. 2, 1999

[54] RESISTOR AND RESISTOR MANUFACTURING METHOD

[75] Inventors: Hirokazu Tsuda, Toyohashi; Toshio Ishikawa, Kariya; Kiyomitsu Oshikawa, Toyohashi, all of Japan

[73] Assignee: Asmo Co., Ltd, Japan

[21] Appl. No.: 905,953

[22] Filed: Aug. 5, 1997

[30] Foreign Application Priority Data

Aug. 8, 1996 [JP] Japan ..... 8-210236

[51] Int. Cl.[6] ..... H01C 7/10

[52] U.S. Cl. ..... 338/22 R

[58] Field of Search ..... 338/22 R, 225 D, 338/271, 323, 324, 327, 328, 330, 331

[56] References Cited

U.S. PATENT DOCUMENTS 4,992,771 2/1991 Caporali et al. ..... 338/22 R
5,351,390 10/1994 Yamada et al. ..... 29/612

FOREIGN PATENT DOCUMENTS 59-24521 6/1984 Japan .
62-254402 11/1987 Japan .
63-5601 1/1988 Japan .
2-98113 4/1990 Japan .

*Primary Examiner*—Teresa Walberg
*Assistant Examiner*—Jeffrey Pwu
*Attorney, Agent, or Firm*—Parkhurst & Wendel

[57] ABSTRACT

A resistor formed by a laminated structure having a resistance body interposed between two conductive plates, electrical connection members being connected to the conductive plates, and a method for manufacturing the resistor. The resistor includes a first connection portion formed on a first conductive plate by partially cutting off a laminate part of a second conductive plate and the resistance body, and a second connection portion formed on the second conductive plate by partially cutting off a laminate part of the first conductive plate and the resistance body. The method for manufacturing the resistor includes the steps of applying solder to one of the two conductive plates and the resistance body, thereafter passing the component through a high temperature oven and thereby melting the solder, and fixing the resistance body and the two conductive plates together in an electrically conductive state with the resistance body interposed between the two conductive plates, by solidifying the solder.

20 Claims, 11 Drawing Sheets

RESISTOR AND RESISTOR MANUFACTURING METHOD

BACKGROUND OF THE INVENTION

1. Field of the Invention

The present invention relates to resistors, such as thermistors, and a resistor manufacturing method used to prevent an overcurrent from flowing when a motor is overloaded.

2. Description of the Related Art

For example, in drive motors for power window devices of automobiles, positive temperature coefficient (PTC) thermistors are used to prevent an overcurrent from flowing when a motor is overloaded.

This type of thermistor has a three-layered laminated structure including a resistor material containing carbon in a resin material interposed between two conductive metal plates such as copper-plated iron plates or brass plates. Furthermore, the thermistor is installed in a motor, and electrical connection members such as lead wires are connected to the above described metal plates.

Such a thermistor has a laminated structure formed by interposing a resistor material between metal plates. Since electrical resistance increases as temperature rise, a pressure or a large current cannot be applied to the structure in the intact laminated state (or laminated shape). In other words, in a case in which electrical connection members such as lead wires are to be connected to the metal plates as described above, the presence of a resistor material prevents the connection of electrical connection members such as lead wires to the metal plates using spot or projection welding or the like while interposing the metal plates between electrodes. In addition, if connection is effected using these methods, pressure or heating deforms or melts the resin used as the binder of resistor material, and resistor characteristics are adversly affected. Furthermore, if lead wires or the like are connected to metal plates by soldering, adhesion strength becomes insufficient and endurance and reliability deteriorate.

FIGS. 15 and 16 show a conventional thermistor 110 of this type, having one pair of wire bound portions 112, 114 to which a terminal 22 and a brush pigtail 24 are connected and disposed in metal plates 116, 118 as shown. The wire bound portions 112, 114 are formed to project out from a main body portion 122 formed by the metal plates 116, 118 and a resistor material 120. Thereby, the brush pigtail 24 and the like are connected to the metal plates 116, 118 using spot or projection welding. As a result, the brush pigtail 24 and the like are connected to metal plates 116, 118 without adversely affecting resistance characteristics, and endurance and reliability can be assured.

The conventional thermistor 110 has a configuration in which the wire bound portions 112, 114 project out from the main body portion 122 including the metal plates 116, 118 and the resistor material 120, so drawbacks arise that involve numerous limitations on the direction in which the brush pigtail 24 and the like are connected, making components difficult to standardize and preventing the use of common manufacturing jigs.

In other words, the wire bound portions 112, 114 are disposed to project out from the main body portion 122, consequently reducing the disposition space within the motor of the application subject. Many limitations are thus placed on the connection space of the pigtail 24 and the like, and the degree of freedom in the connection space is low. In the thermistor 110, the forming positions of wire bound portions 112, 114 must therefore be varied with the motor type of the application subject, its installation position, or its installation direction. Connection portions are not, for example, always formed at the upper corners of the main body portion 122 as shown in FIGS. 15 and 16, and they may have to be formed at lower corners of the main body portion or on the sides thereof. As a result, thermistors must be preset as dedicated components based on individual motors, and thermistors 110 so preset above require the wire bound portions to have different forming positions. Manufacturing jigs, as holding means (so-called pallets), must be preset as dedicated for individual thermistors 110 differing in overall shape. This results in factors adversely affecting cost and productivity.

Other preceding techniques known concerning PTCs, are PTCs improved in chip shape as described in Japanese Patent Application Laid-Open (JP-A) No. 62-254402, PTCs improved in electrode position as described in Japanese Utility Model Application Laid-Open (JP-U) No. 63-5601 and Japanese Patent Application Laid-Open (JP-A) No. 2-98113, and PTCs improved in electrode film as described in Japanese Patent Application Publication (JP-B) No. 59-24521.

SUMMARY OF THE INVENTION

In view of the above described facts, an object of the present invention is to provide resistors which expand the degree of freedom in the direction of electrical connection member connection, standardize components, enable common manufacturing jig use, reduce cost, and improve productivity.

In accordance with a first aspect of the present invention, a resistor comprising:

a resistance body having a symmetrical shape which has cut-off portions;

a first conductive plate being attached to one side of said resistance body, having substantially the same shape as that of said resistance body and having at least one connection portion that opposes and covers at least one of said cut-off portions of said resistance body; and a second conductive plate being attached to the other side of said resistance body, having substantially the same shape as that of said resistance body and having at least one connection portion that opposes and covers said cut-off portions of said resistance body other than those covered by said first conductive plate; and a second connection portion formed on the second conductive plate by partially cutting off a laminate part of the first conductive plate and the resistance body.

In the resistance component according to the first aspect of the present invention, electrical connection members are welded and connected to the two conductive plates laminated to the resistance body has a symmetrical shape having cut-off portions, and the first conductive plate has at least one connection portion that opposes and covers at least one cut-off portions of the resistance body, and the second conductive plate has at least one connection portion that opposes and covers the other(s) of the cut-off portions of the resistance body.

In other words, the present resistance component does not have a configuration in which the first connection portion and the second connection portion project out from the main body portion as in the conventional configuration. Therefore, disposition space within the motor of the application subject is not reduced by the first and second connection portions, so limitations on the connection space of electrical connection members such as a brush pigtail are reduced, and the degree of freedom in the connection direction is raised. As described above, the overall shape of the resistor including the first and second connection portions, i.e., the basic contour, is made line-symmetrical and point-symmetrical having no partially projected portions, i.e., the overall shapes of the resistor are common. Even if forming positions of the first and second connection portions are varied with the motor type of the application subject, and the installation direction or installation position of the resistor, and the resistors are made components dedicated to individual motors. Therefore, it is not necessary to set jigs such as holding means (so-called pallets), used while manufacturing resistors, as dedicated jigs for individual resistors, and common jigs can be used. Therefore, it is possible to reduce cost and introduce automation with improved productivity.

Thus, owing to the resistor according to the present invention, the degree of freedom in the direction of the electrical connection member connection is raised, and components can be standardized. In addition, manufacturing jigs can be used in common. As a result, cost can be reduced and productivity improved.

In accordance with a second aspect of the present invention, A resistor formed by a laminated body having a resistance body interposed between two conductive plates, the resistor having a plurality of connection portions for connecting electrical connection members to respective conductive plates, the resistor comprising:

the resistance body being formed so as to take such a shape that portions corresponding to the plurality of connection portions are cut off from a basic contour of the resistor; and each of the two conductive plates being formed so as to take such a shape that a corresponding portion included in the plurality of connection portions is cut off from the basic contour of the resistor.

As with the first aspect of the present invention, due to the resistor according to the second aspect of the present invention, the degree of freedom in the direction of electrical connection member connection is raised, and components can be standardized. In addition, manufacturing jigs can be used in common. As a result, cost can be reduced and productivity improved.

In accordance with a third aspect of the present invention, A method for manufacturing a resistor, the resistor being formed by a laminated body having a resistance body interposed between two conductive plates, electrical connection members being connected to the two conductive plates, the method comprising the steps of:

setting a first conductive plate of the two conductive plates on a pallet;

applying solder to one of the first conductive plate and the resistance body, and thereafter setting the resistance body on the first conductive plate;

applying solder to one of second conductive plate and the two conductive plates and the resistor material, and thereafter setting the second conductive plate on the resistance body;

passing the pallet through a high temperature oven having a temperature equivalent to at least a melting point of solder and thereby melting the solder; and fixing the resistance body and the two conductive plates together in an electrically conductive state with the resistance body interposed between the two conductive plates, by solidifying the solder.

Owing to the third aspect of the present invention, jigs such as pallets for holding conductive plates and the resistance body can be made common irrespective of the forming positions of the first and second connection portions. Therefore, it is possible to reduce cost and introduce automation with improved productivity.

In accordance with a fourth aspect of the present invention, A method for manufacturing resistor according to claim 18, wherein the solder melting is conducted by making the temperature in the high temperature oven at least 184 degrees Centigrade and making the solder stay in the high temperature oven for a predetermined time.

In the same way as the third aspect of the present invention, owing to the fourth aspect of the present invention, jigs such as pallets for holding conductive plates and resistance body can be made common irrespective of the forming positions of the first and second connection portions. Therefore, it is possible to reduce cost and introduce automation with improved productivity.

DESCRIPTION OF THE PREFERRED EMBODIMENTS

Figure 1:
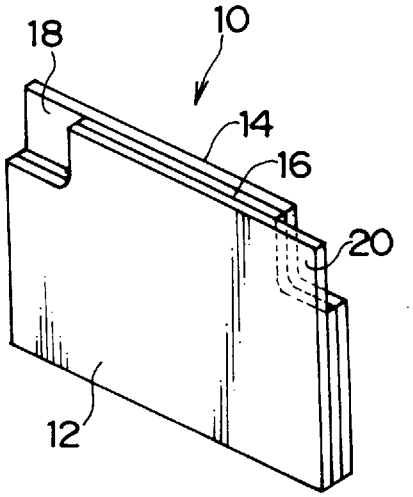
FIG. 1 is a perspective view of a thermistor according to a first embodiment of the present invention.
Figure 2:
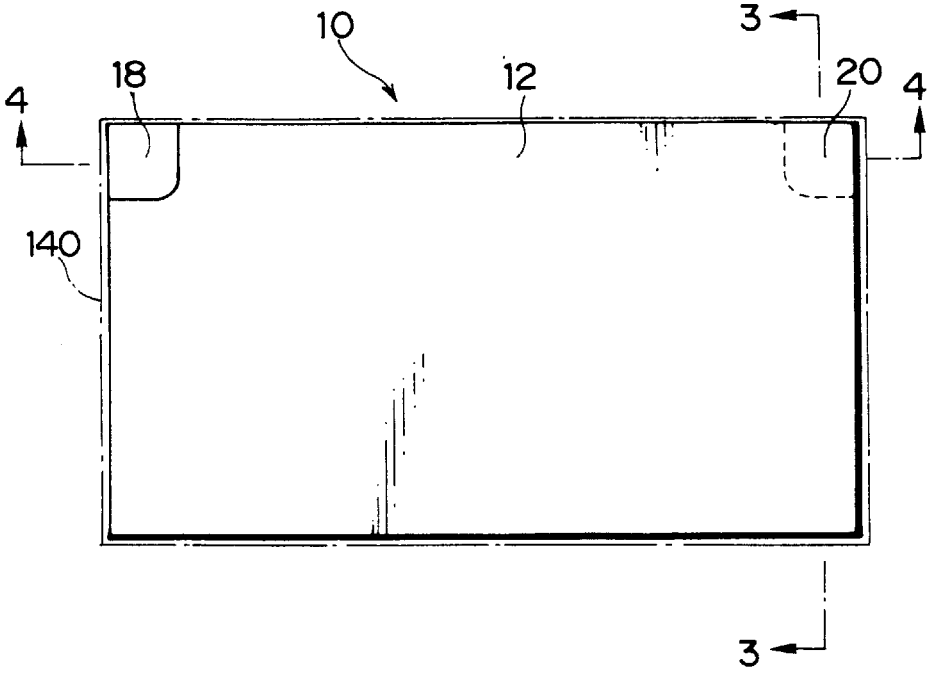
FIG. 2 is a top view of the thermistor according to the first embodiment of the present invention.
Figure 3:
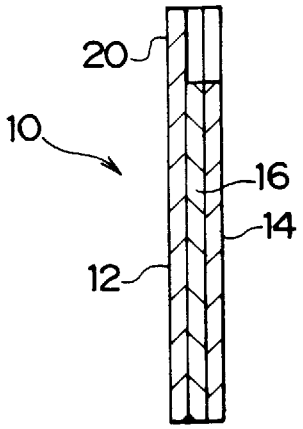
FIG. 3 is a sectional view of the thermistor according to the first embodiment of the present invention taken along line 3—3 in FIG. 2.
Figure 4:
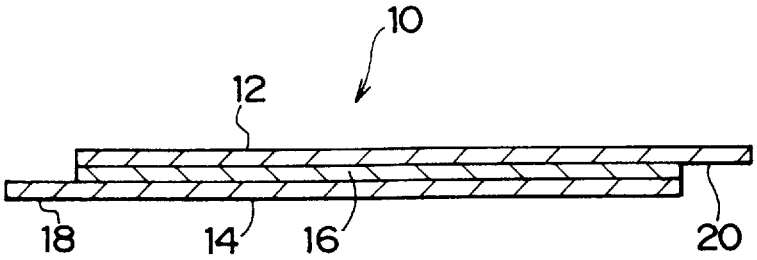
FIG. 4 is a sectional view of the thermistor according to the first embodiment of the present invention taken along line 4—4 in FIG. 2.

FIG. 1 shows a perspective view of a thermistor 10 functioning as a resistor according to a first embodiment of the present invention. FIG. 2 shows a top view of the thermistor 10. FIG. 3 shows a sectional view of the thermistor 10 taken along line 3—3 of FIG. 2. FIG. 4 shows a sectional view of the thermistor 10 taken along line 4—4 of FIG. 2.

The thermistor 10 used is a positive temperature coefficient (PTC) thermistor. The thermistor 10 is formed by metal plates 12 and 14 functioning as two conductive plates and a resistance body 16. The metal plates 12 and 14 are, for example, copper-plated iron or brass. The resistance body 16 is formed by extending, as a plate, a resin material such as, for example, polyethylene, mixed with carbon particles and kneaded and laminating nickel foil on the surfaces opposed to the metal plates. One of these metal plates 12 and 14 is set on the pallet functioning as the holding means, and thereafter solder is applied to one of the metal plates or a resistor material. The resistor material is laid on top of one of the metal plates. Subsequently, solder is applied to the laid resistor material or the other of the metal plates, and the other metal plate is laid on top of the resistor material. An assembly of such plates is passed through a high-temperature oven to solidify solder. These processes provide the thermistor 10 with a three-layer overall laminated structure. Together therewith, the thermistor 10 is formed to be quadrilateral overall when viewed from the top. Alternatively, the resistance body 16 is interposed between the metal plate 12 and the metal plate 14, and they are joined by molten solder. The thermistor 10 is simultaneously provided with a three-layer overall laminated structure and formed to be quadrilateral overall when viewed from the top. Nickel foil applied to the resistance body 16 is adhered to the resistance body 16 by the metal plates 12 and 14 and solder. Reliable conduction with the resistance body 16 and the metal plates 12 and 14 is assured. The thermistor 10 is disposed connected between the feeding terminal and the feeding brush of the electric motor of the application subject.

A first connection portion 18 and a second connection portion 20 are formed in the thermistor 10. By partially cutting off the upper corner portions of the one metal plate 12 of the laminated two metal plates 12 and 14 and the resistance body 16 shown in FIGS. 1 and 2 from the basic contour of the thermistor 10, the first connection portion 18 is formed on the upper corner portion of the other metal plate 14. On the other hand, by partially cutting off the upper corner portions (on the side opposite the thermistor from the first connection portion 18 when viewed from the top) of the other metal plate 14 of the laminated two metal plates 12 and 14 and the resistance body 16 shown in FIGS. 1 and 2 from the basic contour of the thermistor 10, the second connection portion 20 is formed on the upper corner portion of the one metal plate 12. As a result, the overall shape of the thermistor 10 including the first connection portion 18 and the second connection portion 20, i.e., the basic contour 140, is point-symmetrical in that it can be rotated about a center point, and line-symmetrical in that it can be folded along an X or Y axis that perpendicularly intersects at a center point and have no partially projected portions as seen from the top, i.e., is quadrilateral in shape.

The operation of the present first embodiment is described below.

Figure 5:
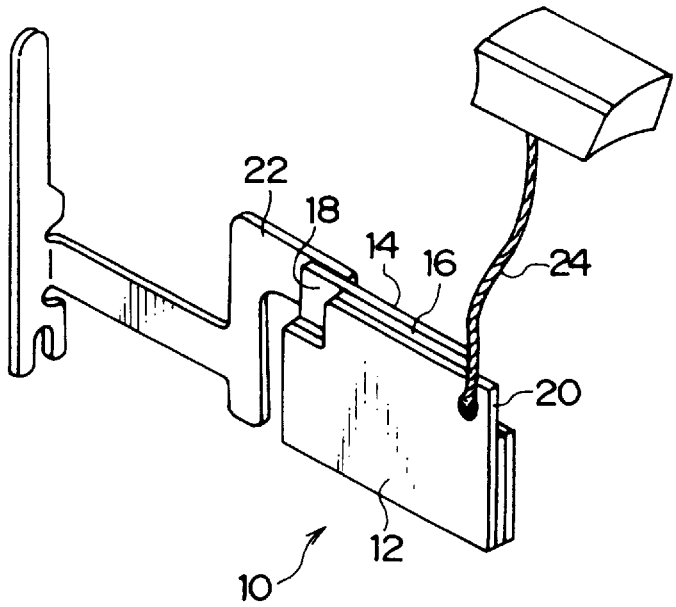
FIG. 5 is a perspective view showing the connection states of a first connection portion and a second connection portion installed in the thermistor according to the first embodiment of the present invention.

In the thermistor 10 having the above structure, a terminal 22 functioning as an electrical connection member is subjected to pressure welding, and connected to the first connection portion 18 of the other metal plate 12 of the two laminated metal plates 12 and 14 having the resistance body 16 interposed in between them as shown in FIG. 5. Furthermore, a brush pigtail 24 functioning as an electrical connection member is subject to pressure welding, and connected to the second connection portion 20 of the one metal plate 14.

In the thermistor 10, the first connection portion 18 is formed on the metal plate 14, and the second connection portion 20 is formed on the metal plate 12. An overall shape of the thermistor 10, including the first connection portion 18 and the second connection portion 20, is point-symmetrical and line-symmetrical, having no partially projected portions when viewed from the top.

In other words, unlike the conventional configuration, the thermistor 10 does not have a structure in which the first connection portion 18 and the second connection portion 20 project out from the main body portion. Therefore, the disposition space within the motor of the application subject is not reduced by the first connection portion 18 and the second connection portion 20. Therefore, limitations on the connection space of electrical connection members such as the terminal 22 and the brush pigtail 24 are reduced, and the degree of freedom in the direction of connection is raised.

As described above, the overall thermistor 10, including the first connection portion 18 and the second connection portion 20, is point-symmetrical and line-symmetrical, having no partially projected portions, i.e., is quadrilateral in shape when viewed from the top, irrespective of the forming positions of the first connection portion 18 and the second connection portion 20. In other words, the overall shape of the thermistors 10 is common. Even if forming positions of the first connection portion 18 and the second connection portion 20 are varied by the motor type of the application subject, and the installation direction or installation position of the thermistor 10, and the thermistors 10 are set as components dedicated to individual motors, therefore, it is not necessary to set jigs (so-called pallets) such as holding means used during thermistor manufacture as dedicated jigs for individual thermistors 10, and jigs can be used in common. Therefore, it is possible to reduce cost and improve productivity.

Thus, owing to the thermistor 10 according to the present invention, the degree of freedom in the direction of connection of the electrical connection members such as the terminal 22 and the brush pigtail 24 is raised, and components can be standardized. In addition, manufacturing jigs can be used in common. As a result, cost can be reduced and productivity improved.

In the above embodiment, the thermistor 10 is formed to take an overall quadrilateral shape, and the first connection portion 18 and the second connection portion 20 are formed at the upper corners. However, the shape of the thermistor 10 and the forming positions of the first connection portion 18 and the second connection portion 20 are not limited to this. The overall shape of the thermistor may be other than a quadrilateral, and the first connection portion 18 and the second connection portion 20 may be disposed in other positions. Furthermore, in connection between the conductive plate and the electrical connection member, the electrical connection member may be pressed against and contacted with the connection portion of the conductive plate. Other embodiments of the present invention are described next. Detailed description will be omitted for members which are the same as for the first embodiment.

Figure 6:
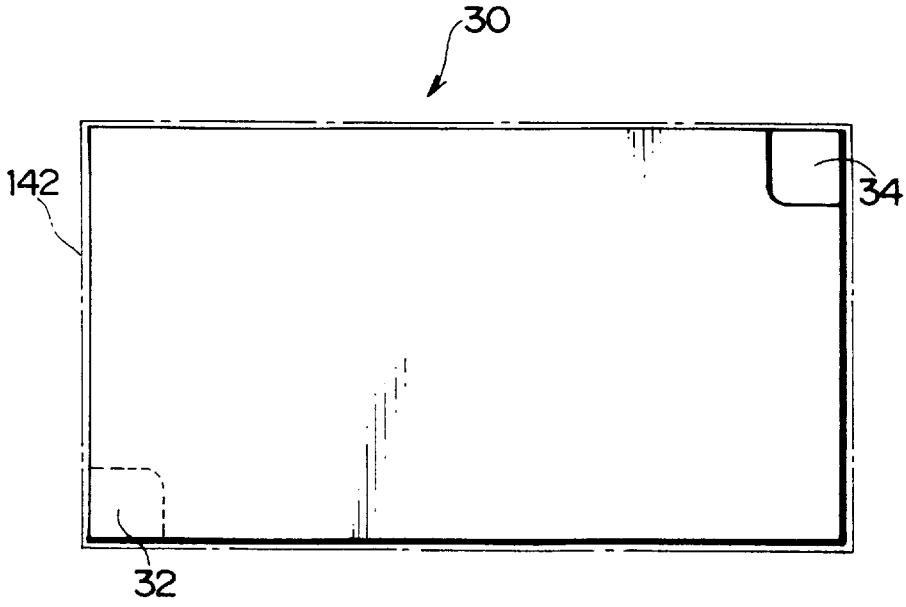
FIG. 6 is a top view of a thermistor according to a second embodiment of the present invention.

In FIG. 6, a top view is shown of a thermistor 30 functioning as a resistor according to a second embodiment.

The thermistor 30 takes the overall shape of a quadrilateral when viewed from the top, and a first connection portion 32 and a second connection portion 34 are formed thereon. In FIG. 6 (top view), the first connection portion 32 is formed diagonally opposite the second connection portion 34. In this thermistor 30 as well, the shape of the thermistor 30 as a whole including the first connection portion 32 and the second connection portion 34, i.e., the basic contour 142, is point-symmetrical and line-symmetrical, having no partially projected portions when viewed from the top, i.e., is quadrilateral in shape.

The thermistor 30 does not use a configuration in which the first 32 and second 34 connection portions project out from the main body portion as in the conventional configuration. Therefore, the disposition space within the motor of the application subject is not reduced by the first 32 and second 34 connection portions. Therefore, limitations on the connection space of the electrical connection members such as the terminal 22 and the brush pigtail 24 are reduced, and the degree of freedom in the connection direction is raised.

As described above, the overall thermistor 30, including the first 32 and second 34 connection portions is point-symmetrical and line-symmetrical, having no partially projected portions, i.e., is quadrilateral in shape, when viewed from the top, irrespective of the forming positions of the first 18 and second 20 connection portions. In other words, the overall shape of thermistors 30 is common (standardized) Even if forming positions of the first 32 and second 34 connection portions vary with the motor type of the application subject, and the installation direction or installation position of the thermistor 30, and the thermistors 30 are set as components dedicated to individual motors, therefore, it is not necessary to set jigs such as holding means (so-called pallets) used in thermistor manufacturing as dedicated jigs based on individual thermistors 30, and jigs can be used in common. Therefore, it is possible to reduce cost and improve productivity.

Figure 7:
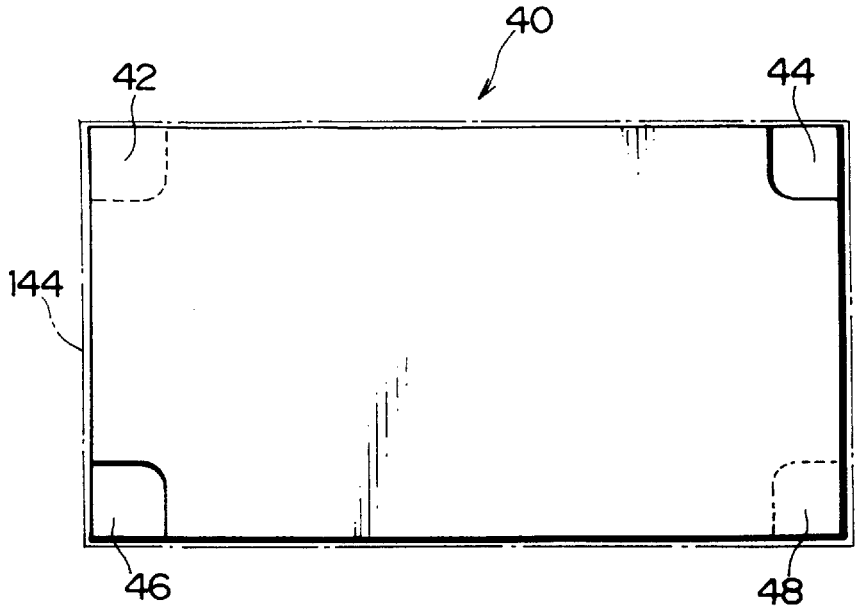
FIG. 7 is a top view of a thermistor according to a third embodiment of the present invention.

FIG. 7 shows a top view of a thermistor 40 functioning as a resistor according to a third embodiment.

The overall thermistor 40 is quadrilateral when viewed from the top, and a first connection portion 42 and a second connection portion 44 are formed thereon. In addition, a third connection portion 46 and a fourth connection portion 48 are formed thereon. In other words, a connection portion is formed on each of corners of the thermistor 40 taking the shape of a quadrilateral. In this thermistor 40 as well, the shape of the thermistor 40 as a whole including the first connection portion 42, the second connection portion 44, the third connection portion 46, and the fourth connection portion 48, i.e., the basic contour 144 is point-symmetrical and line-symmetrical having no partially projected portions when viewed from the top, i.e., is quadrilateral in shape.

Unlike in the conventional configuration, the thermistor 40 does not have a configuration in which the first 42, second 44, third 46, and fourth 48 connection portions project out from the main body portion. Therefore, the disposition space within the motor of the application subject is not reduced by these connection portions. Therefore, limitations on the connection space of the electrical connection members such as the terminal 22 and the brush pigtail 24 are reduced, and the degree of freedom in the connection direction is raised.

As described above, the overall thermistor 40 is point-symmetrical and line-symmetrical, having no partially projected portions, i.e., is quadrilateral in shape, when viewed from the top. In other words, the overall shapes of thermistors 40 are common (standardized). Even if the thermistors 40 are set as dedicated components by the motor type of the application subject, and the installation direction or installation position of the thermistor, jigs need not be set as holding means (so-called pallets) used during thermistor manufacturing as dedicated jigs for individual thermistors 40, and the jigs can be used in common. Therefore, it is possible to reduce cost and improve productivity.

Figure 8:
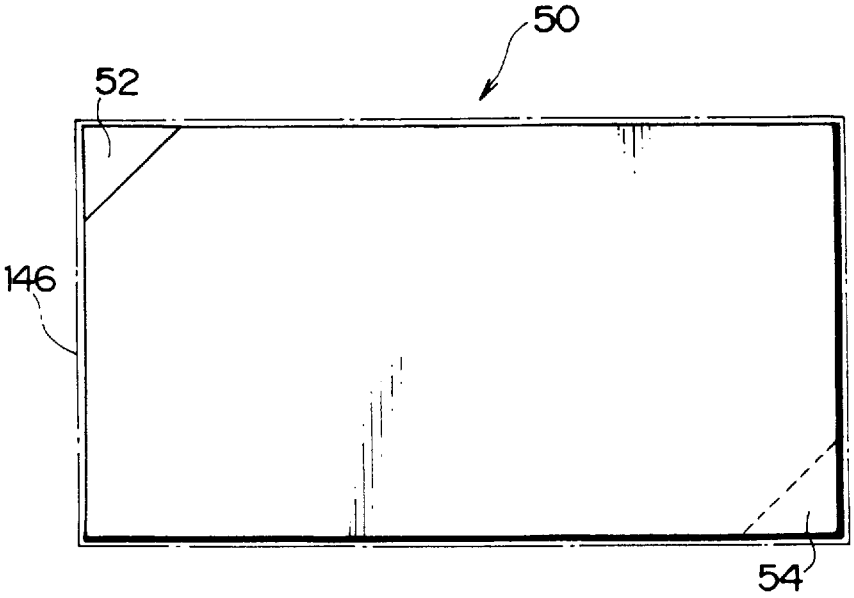
FIG. 8 is a top view of a thermistor according to a fourth embodiment of the present invention.

FIG. 8 shows a top view of a thermistor 50 functioning as a resistor according to a fourth embodiment.

The overall thermistor 50 is quadrilateral when viewed from the top, and a first 52 and second 54 connection portions are formed thereon. Unlike the first 52 and second 54 connection portions in the above embodiments each formed so as to be nearly quadrilateral, the first 52 and second 54 connection portions are formed as nearly a triangle. Also in this thermistor 50, the overall shape of the thermistor 50, including the first 52 and second 54 connection portions, i.e., the basic contour 146, is point-symmetrical and line-symmetrical, having no partially projected portions when viewed from the top, i.e., is quadrilateral in shape.

In the thermistor 50, therefore, the disposition space within the motor of the application subject is not reduced by the first 52 and second 54 connection portions, and the degree of freedom in the direction of connection is raised.

Even if the thermistors 50 are set as dedicated components by the motor type of the application subject and the installation direction (position) of the thermistor, therefore, jigs need not be set as holding means (so-called pallets) in thermistor manufacturing as dedicated jigs for individual thermistors 50, and the jigs can be used in common. Therefore, it is possible to reduce cost and improve productivity.

Figure 9:
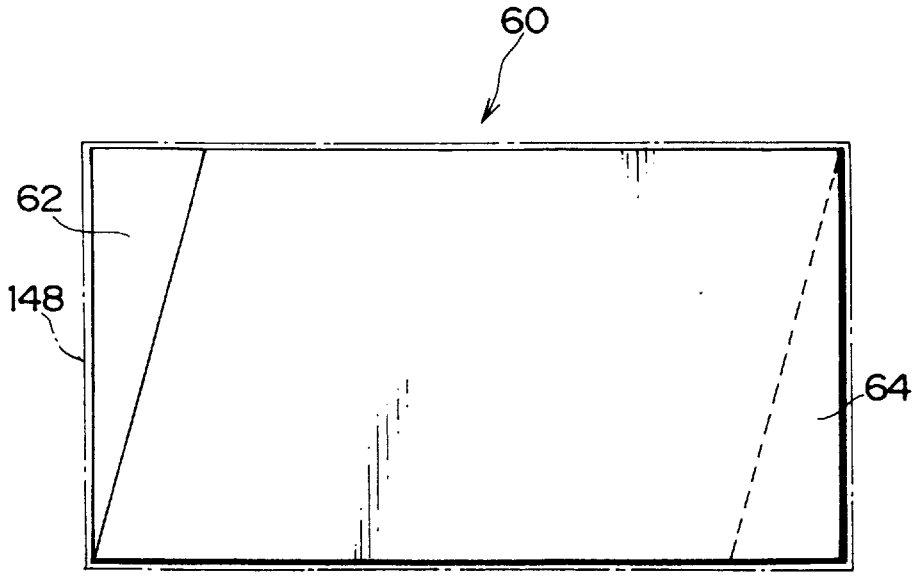
FIG. 9 is a top view of a thermistor according to a fifth embodiment of the present invention.

FIG. 9 shows a top view of a thermistor 60 functioning as a resistor according to a fifth embodiment.

The overall thermistor 60 is quadrilateral when viewed from the top, and a first 62 and second 64 connection portions are formed thereon. Unlike the above embodiments, the first 62 and second 64 connection portions are formed as nearly a triangle having one of both sides of the thermistor 60 shown in FIG. 9 as one side thereof. Also, in this thermistor 60, the overall shape of the thermistor 60, including the first 62 and second 64 connection portions, i.e., the basic contour 148, is point-symmetrical and line-symmetrical, having no partially projected portions when viewed from the top, i.e., is quadrilateral in shape.

In the thermistor 60, therefore, the disposition space within the motor of the application subject is not reduced by the first 62 and second 64 connection portions, and the degree of freedom in the direction of connection is raised.

Even if the thermistors 60 are set as dedicated components by the motor type of the application subject and the installation direction or installation position of the thermistor, therefore, jigs need not be set as holding means (so-called pallets) in thermistor manufacturing as dedicated jigs for individual thermistors 60, and the jigs can be used in common. Therefore, it is possible to reduce cost and improve productivity. In this thermistor 60, the contour shape of the resistance body 16 with the portions corresponding to the connection portions cut off is a shape which can be consecutively produced from a plate-like resistor material without scraps, i.e., a shape such that cutoff of the resistance body 16 corresponding to the connection portions does not produce scrap. Therefore, an expensive resistor material can be used with a high yield, and consequently manufacturing cost can be reduced. This is also favorable to the environment.

Figure 10:
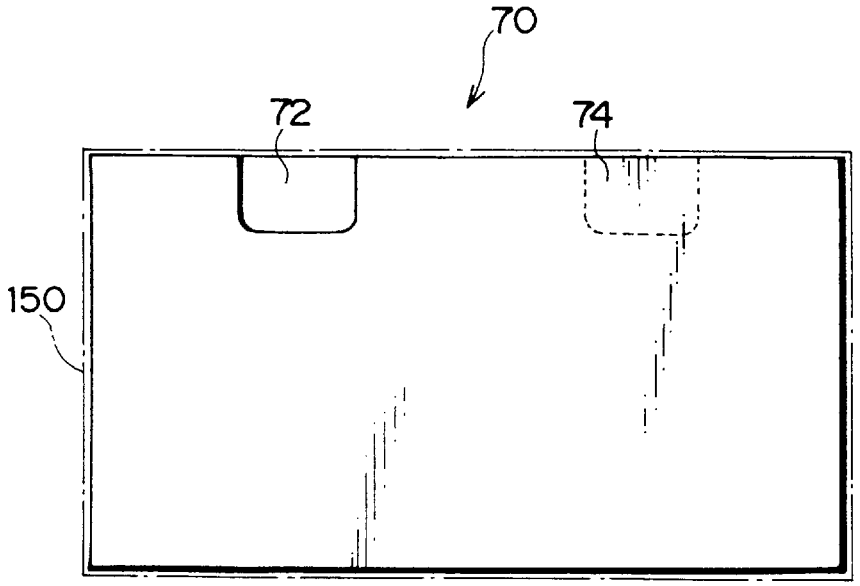
FIG. 10 is a top view of a thermistor according to a sixth embodiment of the present invention.

FIG. 10 shows a top view of a thermistor 70 functioning as a resistor according to a sixth embodiment.

The overall thermistor 70 is quadrilateral when viewed from the top, and a first 72 and second 74 connection portions are formed thereon. Unlike the above embodiments, the first 72 and second 74 connection portions are formed at the upper edge portions of the thermistor 70 as shown in FIG. 10. Also, in this thermistor 70, the overall shape of the thermistor 70, including the first 72 and second 74 connection portions, i.e., the basic contour 150, is point-symmetrical and line-symmetrical, having no partially projected portions when viewed from the top, i.e., is quadrilateral in shape.

In the thermistor 70, therefore, the disposition space within the motor of the application subject is not reduced by the first 72 and second 74 connection portions, and the degree of freedom in the direction of connection is raised.

Even if the thermistors 70 are set as dedicated components by the motor type of the application subject and the installation direction or installation position of the thermistor, therefore, jigs need not be set as holding means (so-called pallets) in thermistor manufacturing as dedicated jigs for individual thermistors 70, and the jigs can be used in common. Therefore, it is possible to reduce cost and improve productivity.

Figure 11:
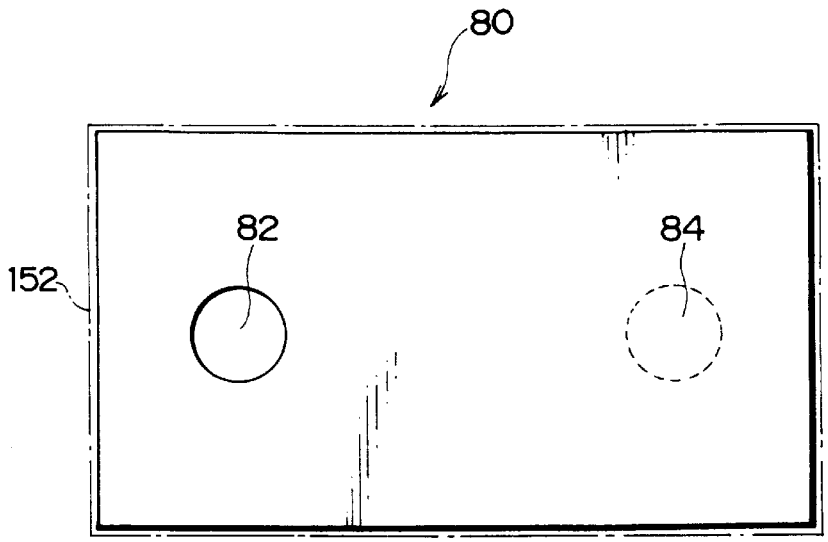
FIG. 11 is a top view of a thermistor according to a seventh embodiment of the present invention.

FIG. 11 shows a top view of a thermistor 80 functioning as a resistor according to a seventh embodiment.

The overall thermistor 80 is quadrilateral when viewed from the top, and a first 82 and second 84 connection portions are formed thereon. Unlike the above embodiments, the first 82 and second 84 connection portions are formed nearly in central portions of the thermistor 80 as shown in FIG. 11. Also, in this thermistor 80, the overall shape of the thermistor 80, including the first 82 and second 84 connection portions, i.e., the basic contour 152, is point-symmetrical and line-symmetrical, having no partially projected portions when viewed from the top, i.e., is quadrilateral in shape.

In the thermistor 80, therefore, the disposition space within the motor of the application subject is not reduced by the first 82 and second 84 connection portions, and the degree of freedom in the direction of connection is raised.

Even if the thermistors 80 are set as dedicated components by the motor type of the application subject and the installation direction or installation position of the thermistor, therefore, jigs need not be set as holding means (so-called pallets) in thermistor manufacturing as dedicated jigs for individual thermistors 80, and the jigs can be used in common. Therefore, it is possible to reduce cost and improve productivity.

Figure 12:
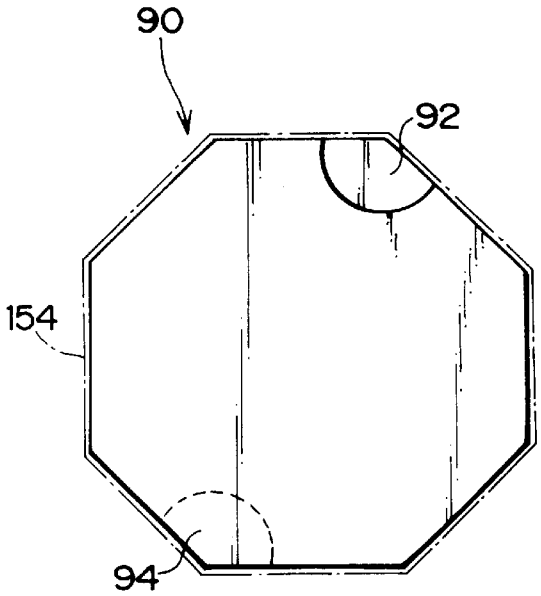
FIG. 12 is a top view of a thermistor according to an eighth embodiment of the present invention.

FIG. 12 shows a top view of a thermistor 90 functioning as a resistor according to an eighth embodiment.

Unlike the above embodiments, the overall thermistor 90 is octagonal when viewed from the top, and a first 92 and second 94 connection portions are formed so as to be positioned, for example, diagonally opposite to each other. Also, in this thermistor 90, the overall shape of the thermistor 90, including the first 92 and second 94 connection portions, i.e., the basic contour 154, is point-symmetrical and line-symmetrical, having no partially projected portions when viewed from the top, i.e., is octagonal in shape.

In the thermistor 90, therefore, the disposition space within the motor of the application subject is not reduced by the first 92 and second 94 connection portions, and the degree of freedom in the direction of connection is raised.

Even if the thermistors 90 are set as dedicated components by the motor type of the application subject and the installation direction or installation position of the thermistor, therefore, jigs need not be set as holding means (so-called pallets) in thermistor manufacturing as dedicated jigs for individual thermistors 90, and the jigs can be used in common. Therefore, it is possible to reduce cost and improve productivity.

Figure 13:
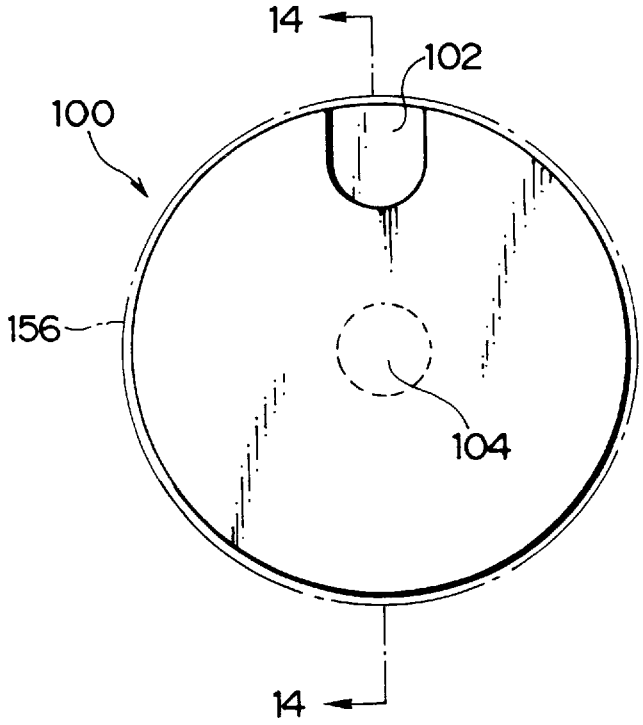
FIG. 13 is a top view of a thermistor according to a ninth embodiment of the present invention.
Figure 14:
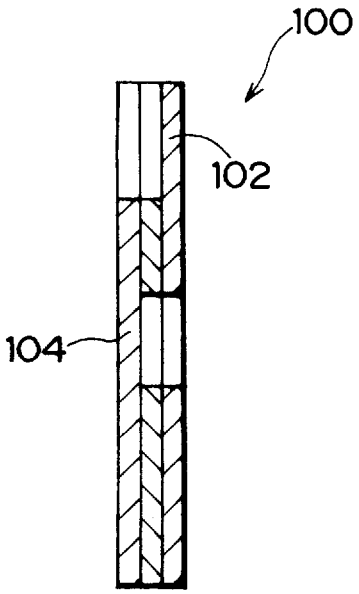
FIG. 14 is a sectional view of the thermistor according to the ninth embodiment of the present invention taken along line 14—14 in FIG. 13.
Figure 15:
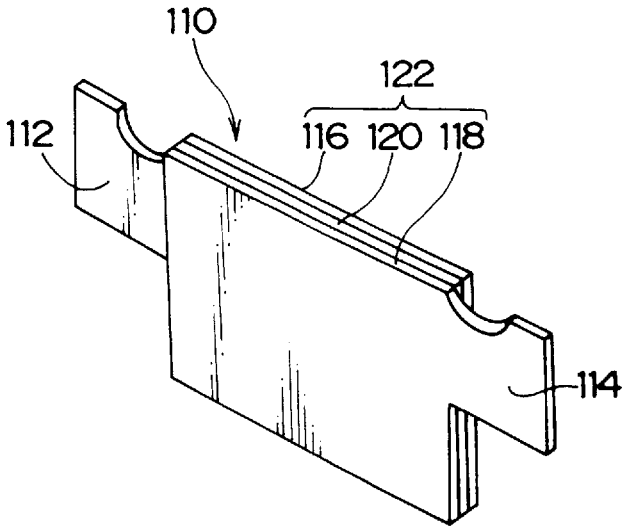
FIG. 15 PRIOR ART
FIG. 15 is a perspective view of a conventional thermistor.
Figure 16:
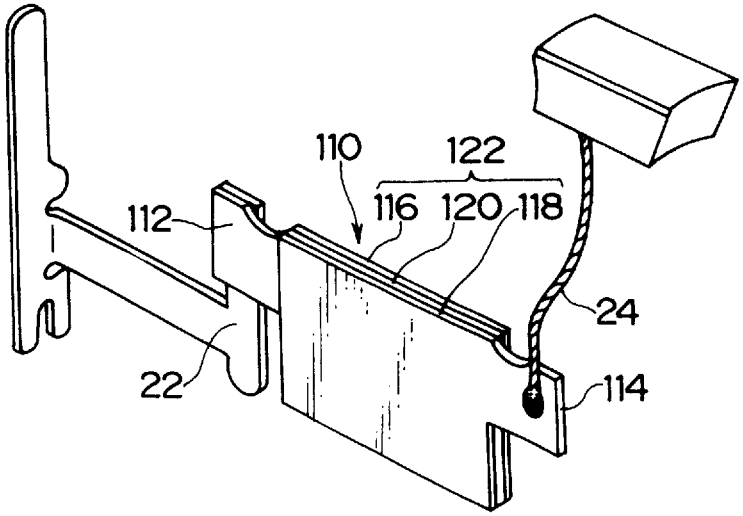
FIG. 16 PRIOR ART
FIG. 16 is a perspective view showing the connection states of connection portions installed in the conventional thermistor.

FIG. 13 shows a top view of a thermistor 100 functioning as a resistor according to a ninth embodiment. In FIG. 14, a sectional view of the thermistor 100 taken along line 14—14 of FIG. 13 is shown.

Unlike the above embodiments, the overall thermistor 100 is circular when viewed from the top, and a first 102 and second 104 connection portions are formed thereon. Furthermore, in this case, the first connection portion 102 is formed in the peripheral portion of the thermistor 100, and the second connection portion 104 is formed in the central portion of the thermistor 100.

Also, in this thermistor 100, the overall shape of the thermistor 100, including the first 102 and second 104 connection portions, i.e., the basic contour 156, is point-symmetrical and line-symmetrical, having no partially projected portions when viewed from the top, i.e., is circular in shape.

In the thermistor 100, therefore, the disposition space within the motor of the application subject is not reduced by the first 102 and second 104 connection portions, and the degree of freedom in the direction of connection is raised.

Even if the thermistors 100 are set as dedicated components by the motor type of the application subject and the installation direction or installation position of the thermistor, therefore, jigs need not be set as holding means (so-called pallets) in thermistor manufacturing as dedicated jigs for individual thermistors 100, and the jigs can be used in common. Therefore, it is possible to reduce cost and improve productivity.

Figure 17:
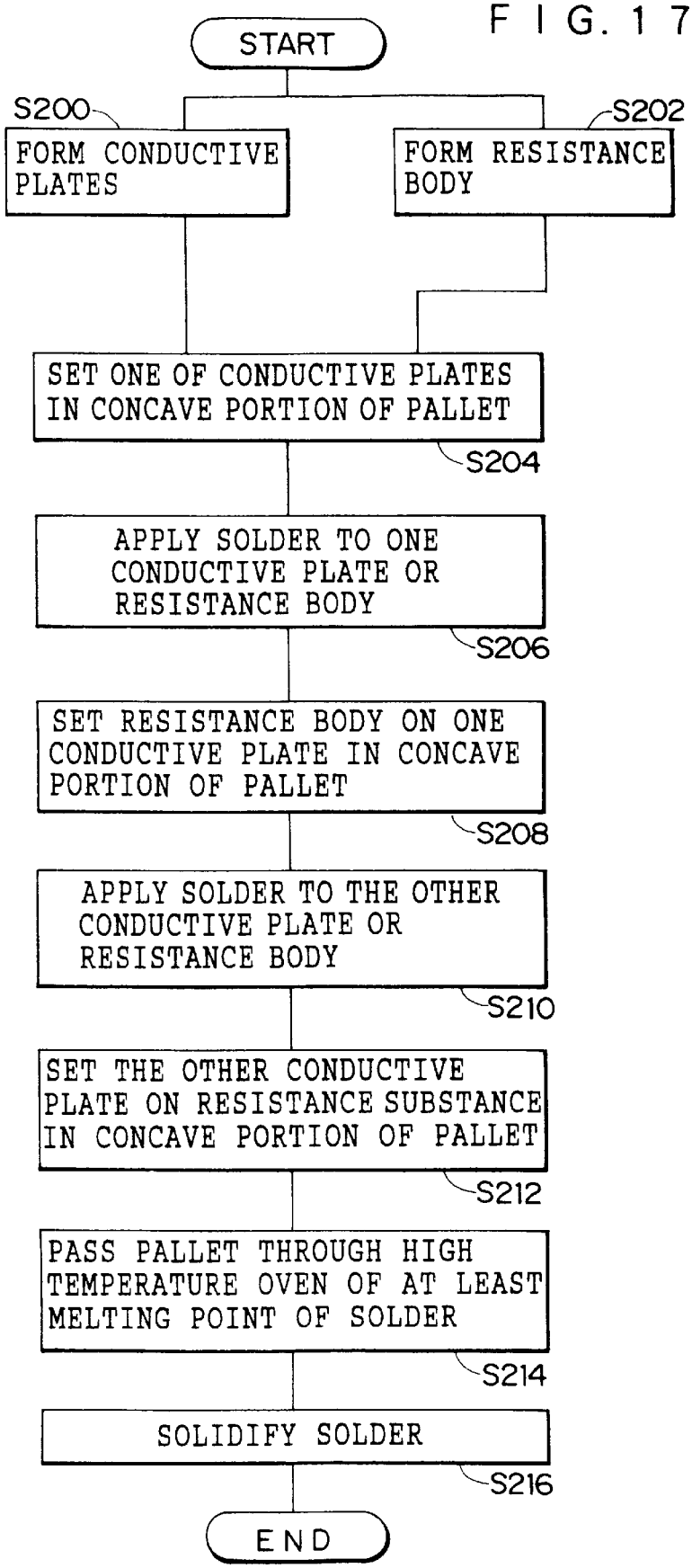
FIG. 17 is a flowchart of thermistor manufacturing according to the present invention.
Figure 18:
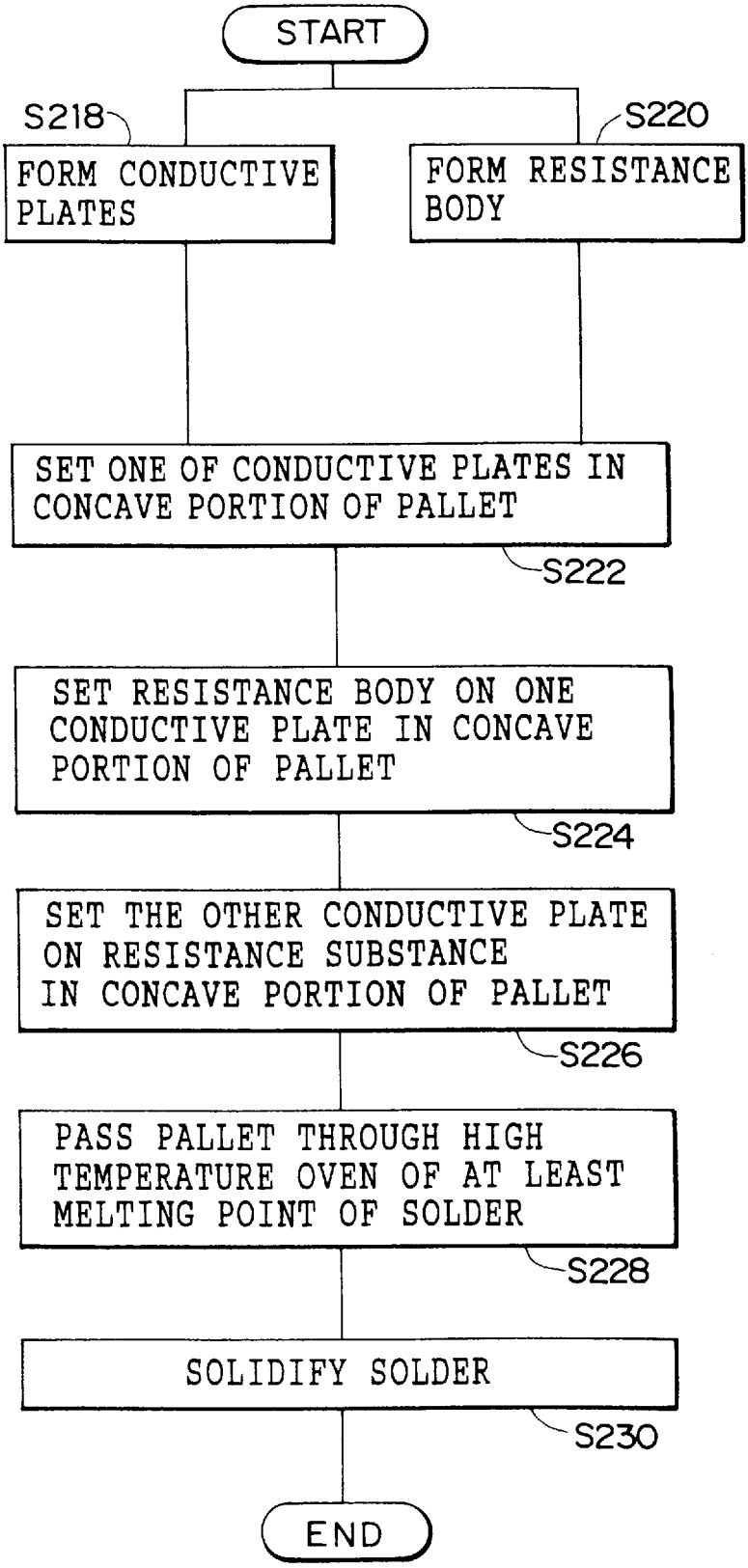
FIG. 18 is a flowchart showing another method of thermistor manufacturing according to the present invention.

A method for manufacturing the thermistors 10, 30, 40, 50, 60, 70, 80, 90 and 100 functioning as resistor of the above described embodiments will now be described by referring to flow charts shown in FIGS. 17 and 18.

First of all, a first manufacturing method will now be described by referring to FIG. 17.

At step (hereafter, abbreviated as S) 200, metal plates 12 and 14 made of a conductive material such as, for example, copper-plated iron plates or brass plates, are subject to press working. Conductive plates each with a portion corresponding to the first connection portion or the second connection portion being cut off from the basic contour of the thermistor are thus formed. At S202, the resistance body 16 is formed to take such a shape that portions corresponding to the first connection portion and the second connection portion formed in the conductive plates are cut off from the basic contour of the thermistor. Subsequently at S204, one of the metal plates 12 and 14 functioning as conductive plates formed at S200 is set in a concave portion formed in a pallet functioning as the holding means in thermistor manufacturing which is not illustrated. At S206, solder is applied to a surface included in surfaces of the metal plate set in the pallet and opposed to the resistance body 16, or a surface included in surfaces of the resistance body 16 and opposed to the metal plate set in the pallet. Subsequently at S208, the resistance body 16 is set in the concave portion of the pallet and on one metal plate set in the concave portion of the pallet. Subsequently at S210, solder is applied to a surface included in surfaces of the other metal plate and opposed to the resistance body 16, or a surface included in surfaces of the resistance body 16 set on the one metal plate and opposed to the surface of the other metal plate. At S212, the other metal plate is set in the concave portion of the pallet and on the resistance body 16 set in the concave portion of the pallet. At S214, the pallet having the two metal plates 12 and 14 and the resistance body 16 set therein is passed through a high temperature oven which has a temperature equivalent to at least the melting point (for example, 184° C.) of solder and which is not illustrated. Solder is thus melted. In the pallet passed through the high temperature oven, at S216 solder is solidified at, for example, room temperature. As a result, the two metal plates 12 and 14 and the resistance body 16 disposed between them are stuck in the electric conduction state by solder.

In manufacturing the present thermistors as well, jigs such as pallets for holding the metal plates 12 and 14 and the resistance body 16 can be made common irrespective of the forming positions of the first connection portion and the second connection portion. Therefore, it is possible to reduce cost and improve productivity.

Subsequently, a second manufacturing method will now be described by referring to FIG. 18.

In this second manufacturing method, the step of applying solder to surfaces of the two metal plates 12 and 14 opposed to the resistance body 16 or applying solder to both surfaces of the resistor material opposed to the metal plates is conducted beforehand. At step 218, metal plates 12 and 14 made of a conductive material such as, for example, copper-plated iron plates or brass plates, are subject to press working. Conductive plates each with a portion corresponding to the first connection portion or the second connection portion being cut off from the basic contour of the thermistor are thus formed. At S220, the resistance body 16 is formed to take such a shape that portions corresponding to the first connection portion and the second connection portion formed in the conductive plates are cut off from the basic contour of the thermistor. Subsequently at S222, one of the metal plates 12 and 14 functioning as conductive plates formed at S218 is set in a concave portion formed in a pallet functioning as the holding means in thermistor manufacturing which is not illustrated. At S224, the resistance body 16 is set in the concave portion of the pallet and on one metal plate set in the concave portion of the pallet. Subsequently at S226, the other metal plate is set in the concave portion of the pallet and on the resistance body 16 set in the concave portion of the pallet. At S228, the pallet having the two metal plates 12 and 14 and the resistance body 16 set therein is passed through a high temperature oven which has a temperature equivalent to at least the melting point (for example, 184° C.) of solder and which is not illustrated. Solder is thus melted. In the pallet passed through the high temperature oven, at S230 solder is solidified at, for example, the room temperature. As a result, the two metal plates 12 and 14 and the resistance body 16 disposed between them are stuck in the electric conduction state by solder.

In manufacturing the present thermistors as well, jigs such as pallets for holding the metal plates 12 and 14 and the resistance body 16 can be made common irrespective of the forming positions of the first connection portion and the second connection portion. Therefore, it is possible to reduce cost and improve productivity.

In the description of the embodiments, a thermistor is used as the resistance component. However, the resistance component is not limited to this, but it may be a plate-like solid resistor or the like.

What is claimed is:

1. A resistor comprising:

a resistance body having a symmetrical shape that has cut-off portions;

a first conductive plate attached to one side of said resistance body, having substantially the same shape as that of said resistance body and having at least one connection portion that opposes and covers at least one of said cut-off portions of said resistance body; and a second conductive plate attached to the other side of said resistance body, having substantially the same shape as that of said resistance body and having at least one connection portion that opposes and covers said cut-off portions of said resistance body other than those covered by said first conductive plate.

2. A resistor according to claim 1, wherein said cut-off portions of said resistance body are disposed in mutually symmetrical positions.

3. A resistor according to claim 1, wherein said symmetrical shape has no partially projected portions.

4. A resistor according to claim 1, wherein said symmetrical shape is a line symmetrical shape.

5. A resistor according to claim 1, wherein said symmetrical shape is a point symmetrical shape.

6. A resistor according to claim 1, wherein a first electrical connection member is connected to said connection portion of said first conductive plate by pressure welding, and a second electrical member is connected to said connection portion of said second conductive plate by pressure welding.

7. A resistor according to claim 1, wherein said first and second conductive plates are metal, and said resistor is a thermistor.

8. A resistor according to claim 7, wherein said thermistor is connected between a feeding terminal and a feeding brush, said feeding terminal and said feeding brush forming an electric motor.

9. A resistor according to claim 1, wherein said resistance body comprises two nickel foils, and a resin layer that is interposed between the two nickel foils and in which carbon particles are contained.

10. A resistor according to claim 3, wherein said cut-off portions of said resistance body are disposed in mutually symmetrical positions.

11. A resistor according to claim 2, wherein a first electrical connection member is connected to said connection portion of said first conductive plate by pressure welding, and a second electrical member is connected to said connection portion of said second conductive plate by pressure welding.

12. A resistor according to claim 3, wherein a first electrical connection member is connected to said connection portion of said first conductive plate by pressure welding, and a second electrical member is connected to said connection portion of said second conductive plate by pressure welding.

13. A resistor according to claim 12, wherein said cut-off portions of said resistance body are disposed in mutually symmetrical positions.

14. A resistor according to claim 11, wherein said basic contour is line symmetrical so that two perpendicular lines intersect at a center of said resistor, and each respective perpendicular line forms two matching halves that overlap exactly when folded along the respective perpendicular line.

15. A resistor according to claim 11, wherein said basic contour is point symmetrical so that along a rotation of said resistor around a center point has more than one position wherein an outline of said basic contour exactly matches an outline of said resistor prior to a complete revolution.

16. A resistor according to claim 12, wherein said basic contour is line symmetrical so that two perpendicular lines intersect at a center of said resistor, each respective perpendicular line forms two matching halves that overlap exactly when folded along the respective perpendicular line.

17. A resistor according to claim 12, wherein said basic contour is point symmetrical so that along a rotation of said resistor around a center point said resistor has more than one position wherein an outline of said basic contour exactly matches an outline of the resistor prior to a complete revolution.

18. A resistor according to claim 16, wherein said cut-off portions of said resistance body are disposed in mutually symmetrical positions.

19. A resistor according to claim 17, wherein said cut-off portions of said resistance body are disposed in mutually symmetrical positions.

20. A resistor according to claim 10, wherein said resistance body comprises two nickel foils, and a resin layer that is interposed between the two nickel foils and in which carbon particles are contained.

* * * * *